US009639017B2

(12) United States Patent
Lee et al.

(10) Patent No.: US 9,639,017 B2
(45) Date of Patent: May 2, 2017

(54) TONER COMPRISING COLORANT WAX DISPERSION

(71) Applicant: Xerox Corporation, Norwalk, CT (US)

(72) Inventors: Frank Ping-Hay Lee, Oakville (CA); Richard P. N. Veregin, Mississauga (CA); Shigang S. Qiu, Toronto (CA); Michael J. D'Amato, Thornhill (CA); Aurelian Valeriu Magdalinis, Aurora (CA); David John William Lawton, Stoney Creek (CA)

(73) Assignee: Xerox Corporation, Norwalk, CT (US)

( * ) Notice: Subject to any disclaimer, the term of this patent is extended or adjusted under 35 U.S.C. 154(b) by 29 days.

(21) Appl. No.: 14/256,941

(22) Filed: Apr. 19, 2014

(65) Prior Publication Data

US 2015/0301463 A1 Oct. 22, 2015

(51) Int. Cl.
*G03G 9/087* (2006.01)
*G03G 9/09* (2006.01)
(Continued)

(52) U.S. Cl.
CPC ..... *G03G 9/0906* (2013.01); *G03G 9/081* (2013.01); *G03G 9/0812* (2013.01);
(Continued)

(58) Field of Classification Search
CPC ..... G03G 9/09; G03G 9/0926; G03G 9/08755
(Continued)

(56) References Cited

U.S. PATENT DOCUMENTS 4,173,492 A * 11/1979 Pollard ..... C08K 9/10 106/415
4,298,672 A 11/1981 Lu
(Continued)

FOREIGN PATENT DOCUMENTS

JP 03168760 A * 7/1991

OTHER PUBLICATIONS

Frank Ping-Hay Lee, et al., U.S. Appl. No. 14/256,937, filed Apr. 19, 2014, "Pigmented Wax Dispersion and Method for Preparing Same," not yet published.
(Continued)

*Primary Examiner* — Christopher Rodee
(74) *Attorney, Agent, or Firm* — Marylou J. Lavoie, Esq. LLC

(57) ABSTRACT

A toner including a resin; and a colorant wax comprising a plurality of colorant wax particles comprising a colorant core surrounded by a wax shell, wherein the colorant wax particles exhibit a particle size distribution of from about 150 nanometers to less than about 300 nanometers; and wherein the colorant wax is prepared by (a) melting and mixing a dry colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form the plurality of colorant wax particles; wherein the melting and mixing of step (a) and the milling of step (b) is done in an immersion media mill; and wherein the combining of step (c) is done using a piston homogenizer.

9 Claims, 3 Drawing Sheets

(51) Int. Cl.
*G03G 9/08* (2006.01)
*G03G 9/093* (2006.01)

(52) U.S. Cl.
CPC ..... *G03G 9/08755* (2013.01); *G03G 9/08782* (2013.01); *G03G 9/0904* (2013.01); *G03G 9/0926* (2013.01); *G03G 9/09392* (2013.01)

(58) Field of Classification Search
USPC ..... 430/108.1, 109.4, 109.3
See application file for complete search history.

(56) References Cited

U.S. PATENT DOCUMENTS 4,338,390 A 7/1982 Lu
4,935,326 A 6/1990 Creatura et al.
4,937,166 A 6/1990 Creatura et al.
5,184,783 A 2/1993 Hockmeyer et al.
5,283,149 A * 2/1994 Tyagi ..... G03G 9/0804 430/108.2
5,346,797 A 9/1994 Kmiecik-Lawrynowicz et al.
5,364,729 A 11/1994 Kmiecik-Lawrynowicz et al.
5,389,958 A 2/1995 Bui et al.
5,403,693 A 4/1995 Patel et al.
5,418,108 A 5/1995 Kmiecik-Lawrynowicz et al.
5,497,948 A 3/1996 Hockmeyer
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,820,040 A 10/1998 Hockmeyer et al.
5,853,943 A 12/1998 Cheng et al.
6,022,659 A * 2/2000 Kanbayashi ..... G03G 9/0821 430/108.23
6,593,049 B1 7/2003 Veregin et al.
6,756,176 B2 6/2004 Stegamat et al.
6,830,860 B2 12/2004 Sacripante et al.
7,175,118 B2 2/2007 Hockmeyer
7,399,354 B2 * 7/2008 Metz ..... C09B 67/0003 106/412
7,559,493 B1 7/2009 Hockmeyer et al.
7,828,234 B1 11/2010 Hockmeyer et al.
7,883,036 B1 2/2011 Cullens et al.
7,914,200 B1 3/2011 Hockmeyer et al.
7,973,186 B1 7/2011 Goredema et al.
8,182,133 B1 5/2012 Hockmeyer et al.
8,376,252 B1 2/2013 Hockmeyer et al.
2002/0098435 A1 * 7/2002 Rohr ..... G03G 9/09 430/108.22
2003/0040559 A1 * 2/2003 Hashimoto ..... G03G 9/091 524/93
2004/0053155 A1 * 3/2004 Emoto ..... G03G 9/09 430/137.15
2008/0153027 A1 * 6/2008 Veregin ..... G03G 9/08755 430/113
2011/0250536 A1 10/2011 Veregin et al.
2014/0305340 A1 * 10/2014 Liu ..... G03G 9/0902 106/473
2014/0356778 A1 12/2014 Wolfe et al.
2015/0013567 A1 1/2015 Lopez et al.

OTHER PUBLICATIONS

Frank Ping-Hay Lee, et al., U.S. Appl. No. 14/256,938, filed Apr. 19, 2014, "Aqueous Ink Jet Printing Ink," not yet published.
Frank Ping-Hay Lee, et al., U.S. Appl. No. 14/256,939, filed Apr. 19, 2014, "Process for Preparing an Aqueous Ink Jet Printing Ink," not yet published.

* cited by examiner

TONER COMPRISING COLORANT WAX DISPERSION

RELATED APPLICATIONS

Commonly assigned U.S. patent application Ser. No. 14/256,937, entitled "Pigmented Wax Dispersion And Method For Preparing Same", filed concurrently herewith, is hereby incorporated by reference herein in its entirety.

Commonly assigned U.S. patent application Ser. No. 14/256,938, entitled "Aqueous Ink Jet Printing Ink", filed concurrently herewith, is hereby incorporated by reference herein in its entirety.

Commonly assigned U.S. patent application Ser. No. 14/256,939, entitled "A Process For Preparing An Aqueous Ink Jet Printing Ink", filed concurrently herewith, is hereby incorporated by reference herein in its entirety.

BACKGROUND

Disclosed herein is a toner comprising a colorant wax dispersion and a process for preparing a toner comprising using a single colorant wax dispersion rather than two separate dispersions comprising separate colorant dispersion and a separate wax dispersion.

Aqueous dispersions of dyes or aqueous dispersions of pigments can be dispersed to have an "average" particle or drop size D50 of less than about 150 nanometers and which are stabilized using a dispersant, plus other ingredients including lubricant, solvents and binders. "Average" particle or drop size is typically represented as D50 or $d_{50}$, or defined as the volume median particle size value at the 50th percentile of the particle size distribution, wherein 50% of the particles in the distribution are greater than the $d_{50}$ particle size value, and the other 50% of the particles in the distribution are less than the $d_{50}$ value. Average particle size can be measured by methods that use light scattering technology to infer particle size, such as Dynamic Light Scattering. The particle diameter refers to the length of an individual drop of the discontinuous layer as derived from images of the particles generated by Transmission Electron Microscopy or from Dynamic Light Scattering measurements.

Pigments are typically heavier than water and tend to agglomerate and settle unless they are stabilized by a dispersant.

Numerous processes are within the purview of those skilled in the art for the preparation of toners. Emulsion aggregation (EA) is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering tribo electrically thereto; and single component systems (SDC), which may use only toner. Placing charge on the particles, to enable movement and development of images via electric fields, is most often accomplished with tribo electricity. Tribo electric charging may occur either by mixing the toner with larger carrier beads in a two component development system or by rubbing the toner between a blade and donor roll in a single component system.

Emulsion aggregation toners can be prepared using aqueous dispersions of pigments and aqueous dispersions of waxes. A typical wax loading for emulsion aggregations toners is about 7 weight percent wax based on the total weight of the toner composition. A typical pigment loading for emulsion aggregation toners is about 5.5 weight percent cyan pigment, or 9.0 weight percent magenta pigment, based on the total weight of the toner composition. Separate wax dispersions and separate pigment dispersions are prepared for use in preparing emulsion aggregation toners. The processing costs for preparing separate wax dispersions and separate pigment dispersions are major components of emulsion aggregation toner cost structure.

Hyper-pigmented emulsion aggregation are desirable. A hyper-pigmented emulsion aggregation toner has a smaller toner particle size than currently available emulsion aggregation toners. In order to achieve good print quality, such as good color gamut, smaller particle sized toners require higher pigment loading. Hyper-pigmented emulsion aggregation toners can require 1.4 times the amount of pigment as currently available emulsion aggregation toners. However, the amount of pigment which can be incorporated into hyper-pigmented toner compositions is limited. High pigment loaded toners may require coalescence time that is longer than current emulsion aggregation processes and therefore result in higher manufacturing cost.

Currently available toners and toner processes are suitable for their intended purposes. However a need remains for improved toners and toner processes including improved methods for producing toner, which decrease the production time and cost. Further, a need remains for improved toners and toner processes that enable smaller toner particle size, such as 3.8 micrometer D50 diameter, than currently available emulsion aggregation toners. Further, a need remains for improved toners and toner processes that provided enhanced print quality including improved color gamut. What is further needed is a toner and toner process that provides hyper-pigmented emulsion aggregation toner.

The appropriate components and process aspects of the each of the foregoing U.S. patents and patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described herein is a toner comprising a resin; and a colorant wax comprising a plurality of colorant wax particles comprising a colorant core surrounded by a wax shell, wherein the colorant wax particles exhibit a particle size distribution of from about 150 nanometers to less than about 300 nanometers; and wherein the colorant wax is prepared by (a) melting and mixing a colorant with at least one wax to form a colorant concentrate, wherein the colorant concentrate contains at least 25 percent by weight of colorant;

(b) milling the colorant concentrate of step (a) to form a milled colorant concentrate; (c) combining the milled colorant concentrate of (b) with water and dispersing to form the plurality of colorant wax particles; wherein the melting and mixing of step (a) and the milling of step (b) is done in an immersion media mill; and wherein the combining of step (c) is done using a piston homogenizer.

Also described is a toner process comprising contacting a resin and a colorant wax dispersion comprising a plurality of colorant wax particles comprising a colorant core surrounded by a wax shell, wherein the colorant wax particles exhibit a particle size distribution of from about 150 nanometers to less than about 200 nanometers; and wherein the colorant wax is prepared by (a) melting and mixing a colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form the plurality of colorant wax particles to form a blend; wherein the melting and mixing of step (a) and the milling of step (b) is done in an immersion media mill; and wherein the combining of step (c) is done using a piston homogenizer; optionally, with an aggregating agent, heating the blend at a temperature near the glass transition temperature of the resin to form aggregated toner particles; optionally, adding a shell resin to the aggregated toner particles, and heating to a further elevated temperature above the glass transition temperature of the resin to coalesce the particles; and recovering the toner particles.

DETAILED DESCRIPTION

Figure 1:
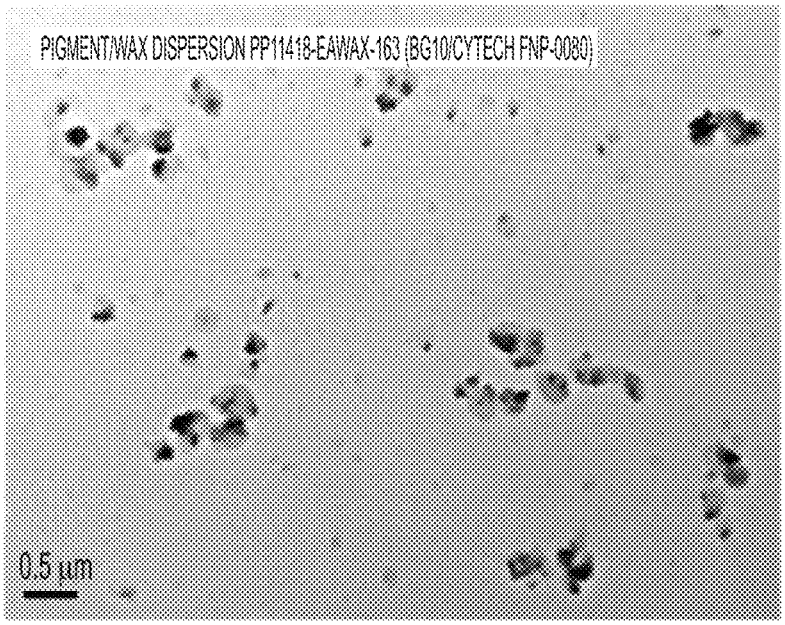
FIG. 1 is a transmission electron micrograph image of a pigmented wax dispersion in accordance with the present disclosure.

Toners and toner methods including processes and equipment for preparing toner compositions using a colorant wax dispersion, in embodiments a pigmented wax dispersion or a dye wax dispersion, instead of separate wax dispersions and pigment dispersions as previously required. The toners and toner methods herein provide reduced manufacturing cost over previous emulsion aggregation toner methods. The toner and toner methods herein further enable preparation of hyper-pigmented and other highly pigmented toners.

As used herein, "hyper-pigmented" means a toner having high pigment loading at low toner mass per unit area (TMA, calculated as known in the art), for example, such toners may have an increased in pigment loading of at least about 25%, at least about 35%, at least about 45%, at least about 55% or more by weight of the toner particle relative to non-hyper-pigmented toners (e.g., toners having carbon black pigment loadings of 6% or lower). In embodiments, a hyper-pigmented toner as used herein is any new formulation wherein the amount of pigment is at least about 1.2 times that found in a control, non-hyper-pigmented or known toner, in embodiments, at least about 1.3 times, at least about 1.4 times, at least about 1.5 times or more pigment as found in a control or known formulation.

In embodiments, "hyper-pigmented" and grammatic forms thereof is meant to describe a toner or toner preparation that on printing and fusing the toner particles to the substrate to form an image of a 100% solid area single color patch, the thickness of that image is less than about 50%, less than about 60%, less than about 70% of a diameter of the toner particles, as provided, for example, in U.S. Publication No. 2011/0250536, which is hereby incorporated by reference herein in its entirety.

In embodiments, "hyper-pigmented" means a toner having higher pigment loading at low TMA than found in conventional toner, such as to provide a sufficient image reflection optical density (ODr) of greater than 1.40, greater than 1.45, or greater than 1.50 when printed and fused on a substrate, such pigment loading chosen so that the ratio of TMA measured for a single color layer in $mg/cm^2$ divided by the volume diameter of the toner particle in microns, is less than about 0.075 to meet that required image density. The TMA may be about 0.55 $mg^2/cm$ or less, about 0.525 $mg^2/cm$ or less, about 0.5 $mg^2/cm$ or less or lower.

In embodiments, the toner herein comprises a resin or a latex polymer; and a colorant wax comprising a plurality of colorant wax particles comprising a colorant core surrounded by a wax shell, wherein the colorant wax particles exhibit a particle size distribution of from about 150 nanometers to less than about 300 nanometers or from about 150 nanometers to less than about 200 nanometers; and wherein the colorant wax is prepared by (a) melting and mixing a colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form the plurality of colorant wax particles; wherein the melting and mixing of step (a) and the milling of step (b) is done in an immersion media mill; and wherein the combining of step (c) is done using a piston homogenizer. In embodiments, the colorant of step (a) is a dry colorant.

The colorant wax dispersion can be prepared by 1) preparing a colorant concentrate; and 2) preparing a colorant wax dispersion by (a) melting and mixing a dry colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form a colorant wax dispersion comprising a plurality of colorant wax particles comprising a colorant core surrounded by a wax shell, wherein the colorant wax particles exhibit a particle size distribution of from about 150 nanometers to less than about 300 nanometers; wherein the melting and mixing of step (a) and the milling of step (b) is done in an immersion media mill; and wherein the combining of step (c) is done using a piston homogenizer.

Thus, in embodiments, the process advantageously comprises using a single colorant wax dispersion rather than separate and distinct colorant dispersion and wax dispersion as in previous processes. In embodiments, the toner advantageously contains a colorant wax, which is a single material colorant-wax, prepared by the present process, rather than a separate colorant and wax as in previous known toners.

Waxes typically have good release properties. In the present toner embodiments, colorants are encapsulated in wax. In certain embodiments, wax encapsulated pigments are provided. In other embodiments, wax encapsulated dyes are provided. The toner compositions prepared herein with wax encapsulated colorant, in embodiments wax encapsulated pigments or wax encapsulated dyes, exhibit improved properties over previous similar toners that lack the instant wax encapsulated colorant. Waxes are usually lighter than pigments or water. The present process exploits this phenomenon employing wax encapsulated pigments which are less likely to settle than "bare" pigments, that is, pigments that are not encapsulated in wax. The present wax encapsulated pigments also exhibit reduced agglomeration over non-wax encapsulated pigments.

The toner process herein comprises contacting a resin (or a latex polymer) and a single dispersion consisting of a colorant wax dispersion comprising a plurality of colorant wax particles comprising a colorant core surrounded by a wax shell, wherein the colorant wax particles exhibit a particle size distribution of from about 150 nanometers to less than about 300 nanometers; and wherein the colorant wax is prepared by (a) melting and mixing a dry colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form the plurality of colorant wax particles to form a blend; optionally, with an aggregating agent, heating the blend at a temperature below the glass transition temperature of the resin, or heating the blend or a temperature near the glass transition temperature of the resin, to form aggregated toner particles; optionally, adding a shell resin to the aggregated toner particles, and heating to a further elevated temperature above the glass transition temperature of the resin to coalesce the particles; and recovering the toner particles. In embodiments, the melting and mixing of step (a) and the milling of step (b) is done in an immersion media mill; and the combining of step (c) is done using a piston homogenizer. In embodiments, the colorant concentrate is a pigment concentrate or a dye concentrate and the stable dispersion of nanometer sized colorant wax is a pigmented wax dispersion or a dye wax dispersion. The processes herein thus include preparing intermediates containing pigmented wax or dyed wax particles. Thus, a single dispersion is used, consisting of a colorant wax dispersion, rather than two separate dispersions, one each of colorant dispersion and wax dispersion as in previous toner processes. The toner process comprises three main processes:

Process 1. Preparing a colorant concentrate, in embodiments a pigment concentrate or dye concentrate, in embodiments, using an immersion media mill;

Process 2. Preparing a pigmented wax dispersion or a dye wax dispersion suing a piston homogenizer; and Process 3. Preparing a toner using an emulsion aggregation process.

In embodiments, preparing the colorant concentrate comprises dispersing, milling, and stabilizing the colorant into a wax base. Pigments can be milled to a Z-average or D50 of about 130 nanometers in diameter.

The particle size of the pigmented wax particles can be measured using any number of suitable Dynamic Light Scattering apparatuses, such as a Malvern Zetasizer. For instance, the Z-average particle size over time can be monitored to gauge the stability of the pigment particles while it is held at elevated temperatures, such as about 120° C. In embodiments, the pigmented wax particles herein have a Z average particle size of from about 80 to about 300 nanometers, or from about 100 to about 250 nanometers, or from about 170 to about 230 nanometers.

The process for preparing the toner compositions herein comprise preparing colorant wax dispersions, in embodiments, pigmented wax dispersions or dye wax dispersions. In embodiments, the toner compositions comprise a wax encapsulated colorant that is prepared by preparing a dispersion of wax encapsulated colorant, in embodiments, pigment or dye, having a D50 of from about 140 nanometers to about 220 nanometers.

The wax dispersion can be prepared using a high-pressure piston homogenizer. In embodiments, the pigmented wax dispersions are prepared as described in U.S. patent application Ser. No. 14/256,937, which is hereby incorporated by reference herein in its entirety. In embodiments, the pigmented wax dispersion is an aqueous submicron pigmented wax dispersion including a plurality of pigmented wax particles comprising a pigment core surrounded by a wax shell, wherein the pigmented wax particles exhibit a particle size distribution of 150 nanometers to less than 300 nanometers. The pigmented wax dispersion can be prepared by the process described in U.S. patent application Ser. No. 14/256,937, including (a) melting and mixing a dry pigment with at least one wax to form a pigment concentrate, wherein the pigment concentrate contains at least 25 percent by weight of pigment; (b) milling the pigment concentrate of step (a) to form a milled pigment concentrate; (c) combining the milled pigment concentrate of (b) with water and dispersing to form a pigmented wax dispersion comprising a plurality of pigmented wax particles comprising a pigment core surrounded by a wax shell, wherein the melting and mixing of step (a) and the milling of step (b) is done in an immersion media mill; and wherein the combining of step (c) is done using a piston homogenizer, and wherein the pigmented wax particles exhibit a particle size distribution of 150 nanometers to less than about 300 nanometers.

The present process for preparing a pigmented wax dispersion comprises (a) melting and mixing a dry pigment with at least one wax to form a pigment concentrate, wherein the pigment concentrate contains at least 25 percent by weight of pigment; (b) milling the pigment concentrate of step (a) to form a milled pigment concentrate; and (c) combining the milled pigment concentrate of (b) with water and dispersing to form a pigmented wax dispersion comprising a plurality of pigmented wax particles comprising a pigment core surrounded by a wax shell, wherein the melting and mixing of step (a) and the milling of step (b) is done in an immersion media mill; and wherein the combining of step (c) is done using a piston homogenizer, and wherein the pigmented wax particles exhibit a particle size distribution of from about 150 nanometers to less than about 300 nanometers.

In embodiments, the pigmented wax particles have an average particle size of from about 80 to about 300 nanometers, or from about 100 to about 250 nanometers, or from about 170 to about 230 nanometers. In certain embodiments, wherein the pigmented wax particles exhibit a particle size distribution of from about 150 to less than about 230 nanometers or from about 150 to less than about 200 nanometers. In embodiments, the pigmented wax particles have a Z average particle size of about 200 nanometers. Average particle size can be measured in any suitable or desired way, such as with a Nanotrac™ 252 (Microtrac, Montgomeryville, Pa., USA) particle size analyzer.

The pigment dispersion process can be carried out in any suitable or desired apparatus. In embodiments, the pigmented wax dispersion processes take place in the setting of a jacketed vessel surrounding a mill, in embodiments a jacketed vessel surrounding a basket mill or an immersion media mill. Generally, the mill comprises a vessel with a heating jacket, a disperser blade for mixing the phase change carrier and optional dispersant and later mixing the phase change carrier and optional dispersant and pigment to wet the pigment, or an immersion mill head (basket assembly) containing the grinding media, in embodiments, ceramic grinding media, for dispersing the pigment.

In one embodiment, all of the melting, mixing, wetting and dispersion takes place in the same vessel and the mixing blade is replaced by the immersion mill or basket mill. In another embodiment, the melting, mixing and wetting takes place in a different vessel and the wetted mixture is then transferred to the immersion mill.

In embodiments, the melting and mixing of step (a) and the milling of step (b) is done in an immersion media mill.

In embodiments, the combining of step (c) is done using a piston homogenizer.

Advantages achieved by the present process including using an immersion media mill, in embodiments a Hockmeyer Immersion Media Mill, for wet pigment grinding include that the immersion media mill requires only one tank for pigment dispersion (wetting) and milling operations. Thus, a simplified process is provided. Previously, wet pigment grinding was done using a horizontal media mill which requires a feed tank, feed pump, and connecting piping for recirculating materials between the feed tank and the milling chamber. Further, the present process using an immersion media mill for steps (a) and (b) benefit in that the immersion media mill uses an overhead drive for supporting the milling basket and turning the impeller. This process can be operated at atmospheric pressure and does not require a mechanical seal for the drive shaft. A horizontal media mill operates under pressure of up to 100 psi and requires a mechanical seal for the drive shaft. A further advantage of the present process is that in an immersion media mill, milling takes place inside the immersion basket. Small milling baskets require small amounts of grinding media and less power to achieve higher impeller velocity.

Melting and mixing the dry pigment with at least one wax can be done using a high shear disperser blade or impeller attachment inside a jacketed vessel. The impeller rotational speed (rpm), tip speed (feet per second) and temperature can be any suitable or desired speed or temperature, in embodiments, at temperatures higher than 100° C., higher than 120° C., 100 to about 170° C., 110 to 170° C., or 110 to 160° C., an rpm of from about 500 to about 5,500 rpm, or 500 to about 5,000 rpm, or 3,000 to about 5,200 rpm, and a tip speed of 4 to 40 feet per second or 23 feet per second to 40 feet per second.

Melting and mixing the dry pigment with at least one wax can be done at any suitable or desired temperature. In embodiments, the melting and mixing of step (a) is done at a temperature of from about 90 to about 180° C., or from about 90 to about 170° C., or from about 100 to about 145° C., or from about 120 to about 140° C.

Melting and mixing the dry pigment with at least one wax can be done at any suitable or desired amount of time. In embodiments, the melting and mixing of step (a) is done for a period of from about 0.1 to about 10 hours, or from about 4 to about 10 hours, or from about 5 to about 8 hours, or from about 6 to about 7 hours. In a specific embodiment, melting and mixing of step (a) is done for a period of from about 0.1 to about 4 hours, or from about 1 to about 4 hours.

Mixing in step (a) can be done by any suitable or desired process. In embodiments, mixing of step (a) is done using a dispersion blade set at from about 500 to about 5,500 revolutions per minute, from about 1,500 to about 4,000 revolutions per minute, or from about 2,000 to about 3,000 revolutions per minute.

The milling of step (b) can be done using any suitable or desired process. In embodiments, milling of step (b) comprises a grinding step. An immersion mill or basket mill can be employed for the milling step (b). The basket mill can contain screens having suitable openings, such as 0.1 millimeter openings, on the side and bottom and can be filled with grinding media, such as ceramic grinding media, in embodiments, 0.3 millimeter diameter spherical zirconia grinding media. The basket mill can use an auger to draw the melt mixed pigment and wax particles into the mill. The centrifugal force exerted by the rotor and grinding media push the slurry out through the side and bottom screen. Milling can proceed for any suitable or desired time, in embodiments, for hours, until a desirable particle size distribution is achieved.

Any suitable or desired mill can be selected for the processes herein. In embodiments, the mill can be as described in U.S. Pat. No. 7,559,493, which is hereby incorporated by reference herein in its entirety. In embodiments, the process herein can be carried out using a Hockmeyer HCPN Dispermill®, available from Hockmeyer Equipment Corporation, which is a micro mill. This is an immersion mill including a vertical basket mill that utilizes grinding media to reduce the particle size of materials, such as for example, pigments. In further embodiments, the mill can be a mill as described in U.S. Pat. Nos. 5,184,783; 5,497,948; 5,820,040; 7,175,118; 7,559,493; 7,828,234; 7,883,036; 7,914,200; 8,182,133; or 8,376,252; each of which is hereby incorporated by reference herein in their entireties.

Any suitable or desired media milling material, such as beads or shot, can be included in the immersion mill head (basket assembly). In embodiments, 40 milliliters of 0.3 millimeter diameter zirconia is disposed in the mill head for the milling step.

In embodiments, the milling step (b) is done at a temperature of from about 90 to about 170° C., or from about 100 to about 145° C., or from about 120 to about 140° C.

Milling step (b) can be done for any suitable or desired amount of time, in embodiments, milling step (b) is done for a period of from about 0.1 to about 8 hours, or from about 1 to about 8 hours, or from about 3 to about 6 hours, or from about 2 to about 4 hours. In a specific embodiment, melting and mixing of step (a) is done for a period of from about 0.1 to about 4 hours.

The milled pigment concentrate of step (b) can be used immediately or stored for later use. In embodiments, the milled pigment concentrate of step (b) is discharged into aluminum trays.

The combining step (c) can be carried out by any suitable or desired process. In embodiments, the combining step (c) comprises (1) pre-homogenizing followed by (2) homogenizing. For example, in embodiments, the combining step (c) comprises (1) pre-homogenizing for a period of from about 0.1 to about 1.5 hours at a temperature of from about 90 to about 170° C., at from about 100 to about 1,000 rpm and about 300 to about 1,000 psi; followed by (2) homogenizing for a period of from about 0.5 to about 5 hours at a temperature of from about 90 to about 170° C., at from about 100 to about 1,000 rpm and about 4,000 to about 8,000 psi.

The process can further comprise (d) cooling the pigmented wax dispersion to any suitable or desired temperature, (e) filtering the pigmented wax dispersion; and (f) discharging the pigmented wax dispersion.

Cooling step (d) can comprises cooling the pigmented wax dispersion to any suitable or desired temperature; in embodiments, cooling to a temperature of from about 20 to about 50° C.

Filtering step (e) can be carried out by any suitable or desired process. In embodiments, filtering the pigmented wax dispersion comprising filtering through a filter having a filter size of from about 100 to about 300 micrometers. In embodiments, the pigmented wax dispersion can be filtered through a 150 micron nylon filter at temperature of 20 to about 50° C.

The pigmented wax dispersion particles provide small sized wax pigment dispersions. The particle size of the pigmented wax particles can be measured using any number of suitable Dynamic Light Scattering apparatuses, such as a Malvern Zetasizer. For instance, the Z-average particle size over time can be monitored to gauge the stability of the pigment particles while it is held at elevated temperatures, such as about 120° C. In embodiments, the pigmented wax particles herein have a Z average particle size of from about 80 to about 300 nanometers, or from about 100 to about 250 nanometers, or from about 120 to about 230 nanometers, or from about 170 to about 230 nanometers.

The pigmented wax dispersion can be present in the toner composition in any suitable or desired amount. In embodiments, the pigmented wax dispersion is present in the toner composition in an amount of from about 0.1 to about 50, or from about 1 to about 25, or from about 2 to about 20 percent by weight based on the total weight of the toner composition.

If a dye based wax dispersion is used, the dye based wax dispersion can also be present in the toner in any suitable or desired amount. In embodiments, the dyed wax dispersion is present in the toner composition in an amount of from about 0.1 to about 45, or from about 1 to about 40, or from about 2 to about 30 percent by weight based on the total weight of the toner composition.

Any suitable or desired resin can be used in the processes herein. In embodiments, the toner resin can be an amorphous resin, a crystalline resin, or a mixture or combination thereof. In further embodiments, the resin can be a polyester resin, including the resins described in U.S. Pat. No. 6,593,049 and U.S. Pat. No. 6,756,176, which are each hereby incorporated by reference herein in their entireties. Suitable resins can also include a mixture of an amorphous polyester resin and a crystalline polyester resin as described in U.S. Pat. No. 6,830,860, which is hereby incorporated by reference herein in its entirety.

In embodiments, the resin is polyester. In certain embodiments, the resin is amorphous polyester, crystalline polyester, or a mixture thereof.

For forming a crystalline polyester, one or more polyol branching monomers can be reacted with a diacid in the presence of an optional catalyst and a further organic diol suitable for forming the crystalline resin including aliphatic diols having from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, and mixtures and combinations thereof, including their structural isomers. The aliphatic diol may be present in any suitable or desired amount, such as from about 25 to about 60 mole percent, or from about 25 to about 55 mole percent, or from about 25 to about 53 mole percent of the resin. In embodiments, a third diol can be selected from the above-described diols in an amount of from about 0 to about 25 mole percent, or from about 1 to about 10 mole percent of the resin.

Examples of organic diacids or diesters including vinyl diacids or vinyl diesters that can be selected for the preparation of the crystalline resin include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, a diester or anhydride thereof, and mixtures and combinations thereof. The organic diacid can be present in any suitable or desired amount, in embodiments, from about 25 to about 60 mole percent, or from about 25 to about 52 mole percent, or from about 25 to about 50 mole percent. In embodiments, a second diacid can be selected from the above-described diacids and can be present in an amount of from about 0 to about 25 mole percent of the resin.

For forming crystalline polyester, one or more polyacid branching monomers can be reacted with a diol in the presence of an optional catalyst and a further organic diacid or diester. The components can be selected in any suitable or desired ratio. In embodiments, the branching monomer can be provided in an amount of from about 0.1 to about 15 mole percent, or from about 1 to about 10 mole percent, or from about 2 to about 5 mole percent, and, in embodiments, a second branching monomer can be selected in any suitable or desired amount, in embodiments, from about 0 to about 10 mole percent, or from about 0.1 to about 10 mole percent of the robust resin.

Examples of diacids or diesters suitable for use in forming the resin herein include vinyl diacids or vinyl diesters used for the preparation of amorphous polyester resins including dicarboxylic acids or diesters such as terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, lutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethladipate, dimethyl dodecylsuccinate, and mixtures and combinations thereof.

The organic diacid or diester may be present in any suitable or desired amount, such as from about 35 to about 60 mole percent of the resin, or from about 42 to about 52 mole percent of the resin, or from about 45 to about 50 mole percent of the resin.

Examples of diols which may be used to prepared the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cycloheaxanediol, diethylene glycol, bis(2-hydroxyethyl) oxide, dipropylene glycol, dibutylene, and mixtures and combinations thereof.

The organic diol can be present in any suitable or desired amount, such as from about 35 to about 60 mole percent of the resin, or from about 42 to about 55 mole percent of the resin, or from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, and mixtures and combinations thereof. Such catalysts may be utilized in any suitable or desired amount, such as from about 0.01 mole percent to about 5 mole percent based on the starting diacid or diester used to generate the polyester resin.

The resin can be prepared by any suitable or desired method. For example, one or more monomers can be combined with one or more acid or diester components in the optional presence of a catalyst, heated, optionally in an inert atmosphere, to condense the monomers into prepolymers. To this mixture can be added one or more diacids or diesters, optionally additional catalyst, optionally a radical inhibitor, with heating, optionally under inert atmosphere, to form the desired final resin (polyester).

Heating can be to any suitable or desired temperature, such as from about 140° C. to about 250° C., or about 160° C. to about 230° C., or about 180° C. to about 220° C.

Any suitable inert atmosphere conditions can be selected, such as under nitrogen purge.

If desired, a radical inhibitor can be used. Any suitable or desired radical inhibitor can be selected, such as hydroquinone, toluhydroquinone, 2,5-DI-tert-butylhydroquinone, and mixtures and combinations thereof. The radical inhibitor can be present in any suitable or desire amount, such as from about 0.01 to about 1.0, about 0.02 to about 0.5, or from about 0.05 to about 0.2 weight percent of the total reactor charge.

In embodiments, the resin can be pre-blended with a weak base or neutralizing agent. In embodiments, the base can be a solid, thereby eliminating the need to use a solution, which avoids the risks and difficulties associated with pumping a solution.

In embodiments, the resin and the neutralizing agent can be simultaneously fed through a co-feeding process which may accurately control the feed rate of the neutralizing agent and the resin into an extruder and which may then be melt mixed followed by emulsification.

In embodiments, the neutralizing agent can be used to neutralize acid groups in the resins. Any suitable or desired neutralizing agent can be selected. In embodiments, the neutralizing agent can be selected from the group consisting of ammonium hydroxide, potassium hydroxide, sodium hydroxide, sodium carbonate, sodium bicarbonate, lithium hydroxide, potassium carbonate, and mixtures and combinations thereof.

The neutralizing agent can be used as a solid, such as sodium hydroxide flakes, etc., in an amount of from about 0.001% to about 50% by weight, or from about 0.01% to about 25% by weight, or from about 0.1% to about 5% by weight, based on the weight of the resin.

In certain embodiments, the neutralizing agent is a solid neutralizing agent selected from the group consisting of ammonium hydroxide flakes, potassium hydroxide flakes, sodium hydroxide flakes, sodium carbonate flakes, sodium bicarbonate flakes, lithium hydroxide flakes, potassium carbonate flakes, organoamines, and mixtures and combinations thereof.

In embodiments, the neutralizing agent can be sodium hydroxide flakes. In embodiments, the surfactant used can be an aqueous solution of alkyldiphenyloxide disulfonate to ensure that proper resin neutralization occurs when using sodium hydroxide flakes and leads to a high quality latex with low coarse content. Alternatively, a solid surfactant of sodium dodecyl benzene sulfonate can be used and co-fed with the resin into the extruder feed hopper eliminating the need to use a surfactant solution thereby providing a simplified and efficient process.

An emulsion formed in accordance with the present process can also include a small amount of water, in embodiments, deionized water, in any suitable or desired amount, such as from about 20% to about 300%, or from about 30% to about 150%, by weight of the resin, at temperatures that melt or soften the resin, such as from about 40° C. to about 140° C., or from about 60° C. to about 100° C.

Further, any other monomer suitable for preparing a latex for use in a toner may be utilized as the resin. As noted above, in embodiments, the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In embodiments, the resin is selected from the group consisting of styrenes, acrylates, methacrylates, butadienes, isoprenes, acrylic acids, methacrylic acids, acrylonitriles, and combinations thereof.

In certain embodiments, the resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof;

amorphous polyester, crystalline polyester, or a mixture thereof;

a crystalline polyester formed by reacting one or more polyol branching monomers with a diacid or diester in the presence of an optional catalyst and a further organic diol suitable for forming the crystalline resin, wherein the further organic diol is selected from the group consisting of 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, and mixtures and combinations thereof, including their structural isomers; wherein the diacid or diester is selected from the group consisting of oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, a diester or anhydride thereof, and mixtures and combinations thereof; and an amorphous polyester formed by reacting one or more polyol branching monomers with a diacid or diester in the presence of an optional catalyst and a further organic diol suitable for forming the amorphous resin, wherein the diacid or diester is selected from the group consisting of terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, lutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethladipate, dimethyl dodecylsuccinate, and mixtures and combinations thereof; wherein the further organic diol is selected from the group consisting of 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cycloheaxanediol, diethylene glycol, bis(2-hydroxyethyl)oxide, dipropylene glycol, dibutylene, and mixtures and combinations thereof.

In embodiments, the latex may be prepared in an aqueous phase containing a surfactant or co-surfactant. Surfactants which may be utilized with the polymer to form a latex dispersion can be ionic or nonionic surfactants, or combinations thereof, in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™ NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quatemized polyoxyethylalkylamines, dodecylbenzyl triethyl ammonium chloride, MIRAPOL® and ALKAQUAT® available from Alkaril Chemical Company, SANISOL (benzalkonium chloride), available from Kao Chemicals, combinations thereof, and the like. In embodiments a suitable cationic surfactant includes SANISOL® B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methylpropionamidine]dihydrochloride, 2,2'-azobis[N-(4-aminophenyl)-2-methylpropionamidine]tetrahydrochloride, 2,2'- azobis[2-methyl-N(phenylmethyl)propionamidine] dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2 (5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer when emulsion polymerization is conducted in accordance with the present disclosure.

In embodiments, the toner particles may further contain optional additives as desired or required. For example, the toner may include positive or negative charge control agents, such as in an amount of from about 0.1 to about 10%, or from about 1 to about 3% by weight of the toner. Examples of suitable charge control agents include quaternary ammonium compounds inclusive of alkyl pyridinium halides, bisulfates, alkyl pyridinium compounds, including those disclosed in U.S. Pat. No. 4,298,672, which is hereby incorporated by reference herein in its entirety, organic sulfate and sulfonate compositions, including those discloses in U.S. Pat. No. 4,338,390, which is hereby incorporated by reference herein in its entirety, cetyl pyridinium tetrafluoroborates, distearyl dimethyl ammonium methyl sulfate, aluminum salts such as CONTRON E84™ or E88™ (Orient Chemical Industries, Ltd.), and mixtures and combinations thereof.

There can also be blended with the toner particles external additive particles including flow aid additives, which additives may be present on the surface of the toner particles. Examples of these additives include metal oxides such as titanium oxide, silicon oxide, aluminum oxide, cerium oxide, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN® 700, and mixtures and combinations thereof.

Silica may be applied to the toner surface for toner flow, tribo enhancement, admix control, improved development and transfer stability, and higher toner blocking temperature. $TiO_2$ may be applied for improved relative humidity (RH) stability, tribo control, and improved development and transfer stability. Zinc stearate, calcium stearate and/or magnesium stearate may optionally also be used as an external additive for providing lubricating properties, developer conductivity tribo enhancement, enabling higher toner charge and charge stability by increasing the number of contacts between toner an carrier particles. In embodiments, a commercially available zinc stearate known as Zinc Stearate L, available from Ferro Corporation, may be used. The external surface additives may be used with or without a coating.

Each of these external additives may be present in any suitable or desired amount, such as from about 0.1 percent by weight to about 5 percent by weight of the toner, or from about 0.2 percent by weight to about 3 percent by weight of the toner.

The latex emulsion containing the resin or resins may be utilized to form a toner by any method within the purview of those skilled in the art. The latex emulsion may be contacted with a colorant, optionally in the form of a colorant dispersion, and other additives to form a toner by a suitable process, in embodiments, an emulsion aggregation and coalescence process. In embodiments, the toner processes herein employ the latex emulsions herein to produce particle sizes that are suitable for emulsion aggregation ultra low melt processes.

Optionally, the toner process further comprises coalescing the aggregated toner particles.

In embodiments, the toner process further comprises wherein the aggregated toner particles form a core, and further comprise, during aggregation, adding additional emulsion to form a shell over the core. In certain embodiments, the additional emulsion forming the shell is the same material as the emulsion forming the core. In other embodiments, the additional emulsion forming the shell can be different from the material forming the toner core. In embodiments, the process comprises adding a second resin to the aggregated toner particles to form a shell over the aggregated toner particles thereby forming a core-shell toner; adding the coalescing agent to the toner particles, and subsequently heating the core-shell toner with the coalescing agent at a temperature above the glass transition temperature of the second resin.

In other embodiments, the toner herein can be formed by a process comprising homogenizing the resin emulsion with a surfactant, the colorant having the reactive component disposed thereon, an optional wax, and an optional coagulant to form a homogenized toner slurry comprising pre-aggregated particles at room temperature; heating the slurry to form aggregated toner particles; optionally freezing the toner slurry once at the desired aggregated particle size; and further heating the aggregated particles in the slurry to coalesce the aggregated particles into toner particles.

Heating to form aggregated toner particles may be to any suitable or desired temperature for any suitable or desired time. In embodiments heating to form aggregated toner particles may be to a temperature below the Tg of the latex, in embodiments to from about 30° C. to about 70° C. or to about 40° C. to about 65° C., for a period of time of from about 0.2 hour to about 6 hours, from about 0.3 hour to about 5 hours, in embodiments, resulting in toner aggregates of from about 3 microns to about 15 microns in volume average diameter, in embodiments of from about 4 microns to about 8 microns in volume average diameter, although not limited.

Freezing the toner slurry to stop particle growth once the desired aggregated particle size is achieved can be by any suitable or desired method. In embodiments, the mixture is cooled in a cooling or freezing step. In embodiments, the mixture is pH adjusted, such as by freezing the aggregation of the particles with a buffer solution having a pH of about 7 to about 12, over a period of from about 1 minute to about 1 hour, or to about 8 hours or from about 2 minutes to about 30 minutes. In embodiments, cooling a coalesced toner slurry includes quenching by adding a cooling medium such as, for example, ice, dry ice and the like, to effect rapid cooling to a temperature of from about 20° C. to about 40° C. or from about 22° C. to about 30° C.

Coalescing the aggregated particles into toner particles can be by any suitable or desired method. In embodiments, coalescing comprises further heating the aggregated particles in the slurry to coalesce the aggregated particles into toner particles. In embodiments, the aggregate suspension may be heated to a temperature at or above the Tg of the latex. Where the particles have a core-shell configuration, heating may be above the Tg of the first latex used to form the core and the Tg of the second latex used to form the shell, to fuse the shell latex with the core latex. In embodiments, the aggregate suspension may be heated to a temperature of from about 80° C. to about 120° C. or from about 85° C. to about 98° C., for a period of time from about 1 hour to about 6 hours or from about 2 hours to about 4 hours.

The toner slurry may then be washed. In embodiments, washing may be carried out at a pH of from about 7 to about 12 or from about 9 to about 11 and the washing may be at a temperature of from about 30° C. to about 70° C. or from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

In embodiments, drying may be carried out at a temperature of from about 35° C. to about 85° C. or from about 45° C. to about 60° C. The drying may be continued until the moisture level of the particles is below a set target of about 1% by weight, in embodiments of less than about 0.7% by weight.

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

The colorant wax dispersions, or pigmented wax dispersions, may be added during formation of the latex polymer in the emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The colorant wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE® N-15 commercially available from Eastman Chemical Products, Inc., VISCOL® 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL® 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The pigmented wax dispersions herein can contain any suitable or desired pigment colorant. In specific embodiments, the colorant is a pigment. In a specific embodiment, the colorant is a pigment selected from the group consisting of a magenta pigment, a cyan pigment, a yellow pigment, a black pigment, and mixtures and combinations thereof. The pigmented wax dispersions may be stabilized by synergists and dispersants.

Examples of suitable pigments include PALIOGEN® Violet 5100 (BASF); PALIOGEN® Violet 5890 (BASF); HELIOGEN® Green L8730 (BASF); LITHOL® Scarlet D3700 (BASF); SUNFAST® Blue 15:4 (Sun Chemical); Hostaperm® Blue B2G-D (Clariant); Hostaperm® Blue B4G (Clariant); SPECTRA® PAC C Blue 15:4 (Sun Chemical); Permanent Red P-F7RK; Hostaperm® Violet BL (Clariant); LITHOL® Scarlet 4440 (BASF); Bon Red C (Dominion Color Company); ORACET® Pink RF (BASF); PALIOGEN® Red 3871 K (BASF); SUNFAST® Blue 15:3 (Sun Chemical); PALIOGEN® Red 3340 (BASF); SUNFAST® Carbazole Violet 23 (Sun Chemical); LITHOL® Fast Scarlet L4300 (BASF); SUNBRITE® Yellow 17 (Sun Chemical); HELIOGEN® Blue L6900, L7020 (BASF); SUNBRITE® Yellow 74 (Sun Chemical); SPECTRA® PAC C Orange 16 (Sun Chemical); HELIOGEN® Blue K6902, K6910 (BASF); SUNFAST® Magenta 122 (Sun Chemical); HELIOGEN® Blue D6840, D7080 (BASF); Sudan Blue OS (BASF); NEOPEN® Blue FF4012 (BASF); PV Fast Blue B2GO1 (Clariant); IRGALITE® Blue GLO (BASF); PALIOGEN® Blue 6470 (BASF); Sudan Orange G (Aldrich); Sudan Orange 220 (BASF); PALIOGEN® Orange 3040 (BASF); PALIOGEN® Yellow 152, 1560 (BASF); LITHOL® Fast Yellow 0991 K (BASF); PALIOTOL® Yellow 1840 (BASF); NOVOPERM® Yellow FGL (Clariant); Ink Jet Yellow 4G VP2532 (Clariant); Toner Yellow HG (Clariant); Lumogen® Yellow D0790 (BASF); Suco-Yellow L1250 (BASF); Suco-Yellow D1355 (BASF); Suco Fast Yellow D1355, D1351 (BASF); HOSTAPERM® Pink E 02 (Clariant); Hansa Brilliant Yellow 5GX03 (Clariant); Permanent Yellow GRL 02 (Clariant); Permanent Rubine L6B 05 (Clariant); FANAL® Pink D4830 (BASF); CINQUASIA® Magenta (DU PONT); PALIOGEN® Black L0084 (BASF); Pigment Black K801 (BASF); and carbon blacks such as REGAL 330™ (Cabot), Nipex 150 (Evonik) Carbon Black 5250 and Carbon Black 5750 (Columbia Chemical), and the like, as well as mixtures thereof.

The colorant wax dispersions, or pigmented wax dispersions, can contain any suitable or desired wax. The wax will be selected in accordance with the desired end product.

In embodiments, the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, polyethylene wax, ester wax, amide wax, fatty acids, fatty alcohols, fatty amides, and combinations thereof.

An aqueous submicron pigmented wax dispersion is thus provided comprising a plurality of pigmented wax particles comprising a pigment core surrounded by a wax shell, wherein the pigmented wax particles exhibit a particle size distribution of from about 150 nanometers to less than about 300 nanometers.

In embodiments, the aqueous submicron pigmented wax dispersion contains at least 25 percent by weight of pigment based on the total weight of the pigment and wax in the pigmented wax dispersion.

The aqueous submicron pigmented wax dispersion is a low viscosity dispersion, having a viscosity that is near that of water. In embodiments, the aqueous submicron pigmented wax dispersion has a viscosity of from about 1 to about 150 centipoise.

In embodiments, the stable aqueous dispersion of wax encapsulated pigment has a D50 of about 140 nanometers to about 220 nanometers, in embodiments, prepared using a high pressure piston homogenizer.

In embodiments, the wax used herein can have a melting point of from about 50° C. to about 100° C. In certain embodiments, the waxes can be polymethylene wax or polyethylene wax having different molecular weights and having a melting point of less about 60° C. to about 100° C. Solid content in the dispersion can vary. In embodiments, the pigmented wax dispersion has a solid content of from about 15 weight percent to about 35 weight percent pigment based on the total weight of the pigment dispersion.

When used in a toner, the colorant wax may be included in the toner any suitable or desired amount, in embodiments, the colorant may be included in the toner in an amount of from about 0.1 to about 35 percent by weight of the toner, or from about 1 to about 25 weight percent of the toner, or from about 2 to about 15 percent by weight of the toner.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidene fluoride, mixtures of resins not in close proximity in the tribo electric series such as polyvinylidene fluoride and acrylics, thermosetting resins such as acrylics, combinations thereof and other known components.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Figure 2:
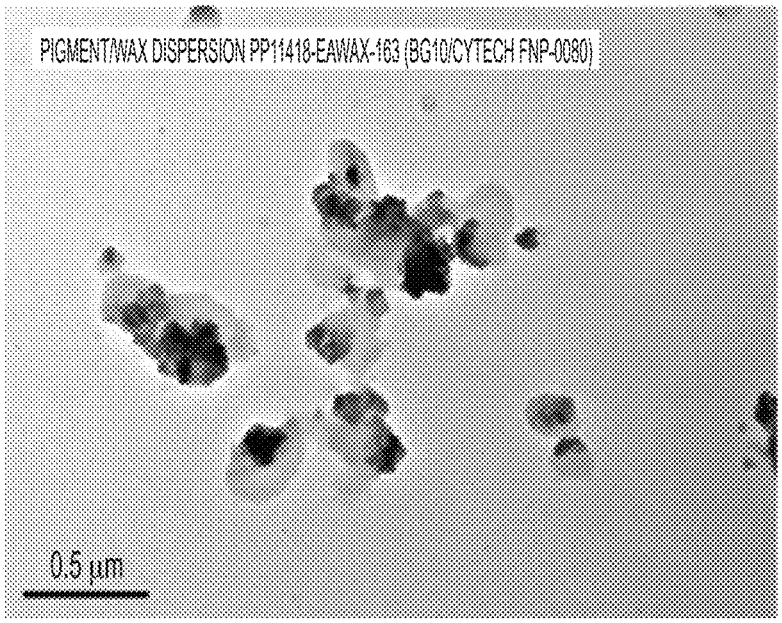
FIG. 2 is a transmission electron micrograph image of a pigmented wax dispersion in accordance with the present disclosure.

FIG. 1 is a transmission electron micrograph picture of a pigmented wax dispersion prepared with Cytech® FNP-80 wax (48.75 weight percent). FIG. 2 is a transmission electron micrograph picture of a pigmented wax dispersion prepared with Clariant® Cyan BG10 pigment (25 weight percent). The wax domain is about 200 nanometers with small pigment aggregate within each domain.

Characteristics of the toner particles may be determined by any suitable technique and apparatus. Volume average particle diameter and geometric standard deviation may be measured using an instrument, such as, a Beckman Coulter MULTISIZER 3, operated in accordance with the instructions of the manufacturer.

Example 1

Preparation of Cyan Pigment Concentrate Containing 25 Weight Percent Clariant® Cyan BG10 Pigment

TABLE 1

| Component | Weight Percent | Quantity (grams) |
|---|---|---|
| Clariant ® Cyan BG10 pigment | 25.00 | 400 |
| PEI-1 | 20.00 | 320 |
| Sunflo ® SFD-B124 | 6.25 | 100 |
| Cytech ® FNP-80 wax | 48.75 | 780 |
| Total | 100.00 | 1,600 |

The pigment concentrate was prepared by wetting and dispersing the pigment and synergist into molten wax and dispersant using a powder disperser, Hockmeyer high-shear disperser impeller, operated at tip speed of 10 to 15 meters per second. When the average particle size of the pigmented dropped to a desirable level, less than about 200 nanometers in diameter, the contents were milled using a Hockmeyer Model HCPN 1/16 Immersion Media Mill. A 0.2 millimeter milling basket filled with 0.3 millimeter zirconia grinding media was used for milling the pigment slurry. When the Z-average of the pigmented was milled to about 130 nanometers in diameter, and PDI (polydispersity index) was about 0.2, as measured by a Malvern Zetasizer particle size analyzer operating at 110° C., the milling step was considered completed. At room temperature, the produce is a stable solid containing fine pigment dispersed in wax. The product can be formed into pellets and stored indefinitely until ready for use.

Example 2

Preparation of Pigmented Wax Dispersion Using a Piston Homogenizer

TABLE 2

| Component | Weight Percent | Mass (grams) |
|---|---|---|
| Cyan Pigment Concentrate of Example 1 | 19.91 | 597.2 |
| TAYCA POWER BN2060 Surfactant (60 percent solids) | 2.65 | 79.6 |
| Deionized Water | 77.44 | 2,323.2 |
| Total | 100 | 3,000 |

The cyan pigment concentrate of Example 1 was melted in water at about 120° C. The molten concentrate was dispersed using a 4 liter stainless steel, jacketed and stirred reactor connected to a piston homogenizer and stabilized pigmented wax particles were formed with surfactant. The process included melting of the pigment concentrate of Example 1 in water containing surfactant under pressure at 120 C. The slurry containing the molten pigment concentrate was then recirculated through the in-line piston homogenizer operating at a pressure of about 6,000 psig. The molten pigment concentrate experiences significant shear force when it passes through the ceramic piston inside the homogenizer and was dispersed into particles having a D50 of about 150 to about 250 nanometers. After recirculating, the contents through the homogenizer for a designated number of passes, the contents were cooled down and discharged as a liquid into a container. The process steps were as follows.

The Tayca Power surfactant was dissolved in the deionized water in a 2 Liter plastic bottle and stirred with a spatula until dissolved.

The pigment concentrate and surfactant solution were pre-homogenized using a reactor 01-08, Gaulin 15-MR, at 120° C. for 20 minutes at 500 rpm and 800 psi.

The pre-homogenized pigment concentrate and surfactant solution were then homogenized using a reactor 01-08, Gaulin 15-MR, at 120° C. for 45 minutes at 500 rpm and 6,000 psi.

The pigmented wax dispersion was then cooled and discharged at about 50° C. and filtered through a 100 micron nylon filter.

Figure 3:
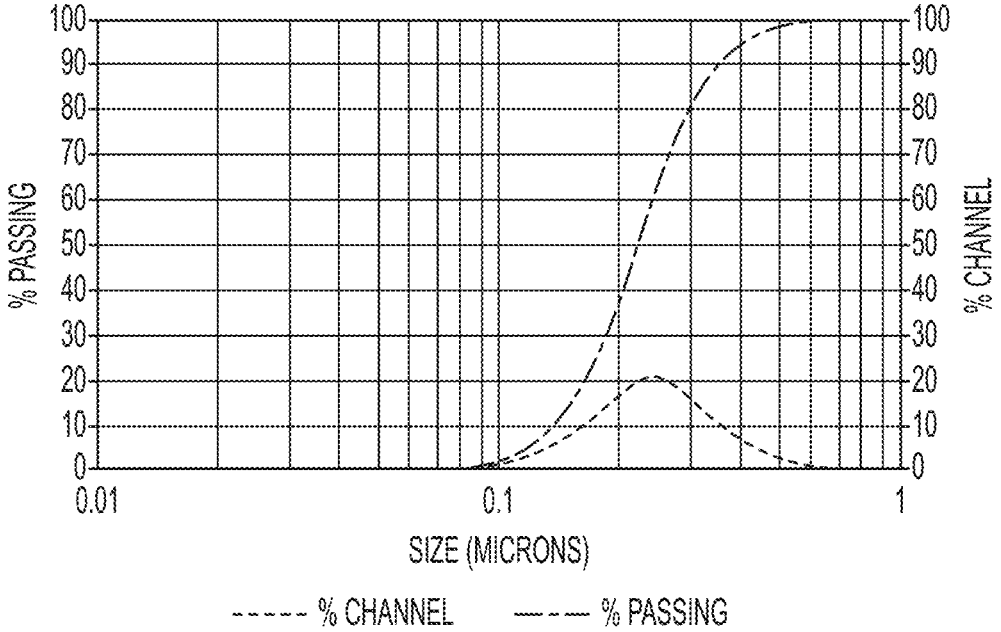
FIG. 3 is a graph showing particle size of a pigmented wax dispersion prepared in accordance with the present embodiments.

The particle size of the pigmented wax dispersion of Example 2 was measured with a Nanotrac™ 252 (Microtrac, Montgomeryville, Pa., USA) at room temperature. Results are shown in FIG. 3.

The pigmented wax dispersion of Example 2 exhibited a particle size distribution of from about 150 to about 300 nanometers with an average particle size about 222 nanometers.

Example 3

Preparing of Cyan Emulsion Aggregation Toner Containing Pigmented Wax Dispersion of Example 2. 121.3 grams of an amorphous polyester resin in an emulsion (polyester emulsion A), having an average molecular weight (Mw) of about 86,000, a number average molecular weight (Mn) of about 5,600, an onset glass transition temperature (Tg onset) of about 56° C., and about 35% solids, 118.2 grams of an amorphous polyester resin in an emulsion (polyester emulsion B) having an Mw of about 19,400, an Mn of about 5,000, a Tg onset of about 60° C., and about 35%, 31.823 grams of a crystalline polyester resin in an emulsion, having an Mw of about 23,300, an Mn of about 10,500, a melting temperature (Tm) of about 71° C. and about 35.4% solids, 112.0 grams of the pigmented wax dispersion of Example 2 (20.95% S.C.) were mixed in a 2 Liter plastic beaker. The ph was reduced to 4.2 using 159.68 grams 0.05M $HNO_3$. Deionized water (DIW) was added to reach the formulation requirement. An additional 123.9 grams DIW was added. 2.873 grams $Al_2(SO_4)_3$ was dissolved in 35.4 grams DIW was added to the mixture. The slurry was then homogenized. The mixture was transferred into a 2 Liter Buchi reactor. The mixture was stirred at 500 rpm and the jacket was set to increase to 40° C. in 20 minutes. The rpm was increased to 525 when the slurry became thicker. The particle size was monitored using a Coulter Counter until the particle size reach 4.6 to 4.8 micrometers. The shell mixture of 64.4 grams of an amorphous polyester resin in an emulsion (polyester emulsion A), having an average molecular weight (Mw) of about 86,000, a number average molecular weight (Mn) of about 5,600, an onset glass transition temperature (Tg onset) of about 56° C., and about 35% solids, 62.8 grams of an amorphous polyester resin in an emulsion (polyester emulsion B) having an Mw of about 19,400, an Mn of about 5,000, a Tg onset of about 60° C., and about 35% solids and 22.2 grams DIW was reduced to ph 3.3 using 0.3M $HNO_3$. This shell mixture was then added into the reactor and the stirring was increased to 570 rpm. The particle size was monitored until it reached 5.6 to 5.8 micrometers. A solution of 6.154 Versene® available from Dow Chemical dissolved in 36.9 grams DIW was prepared. 4% NaOH was then added to the reactor until reaching a pH of 4.2. This was immediately followed by the addition of the Versene® solution. The stirring was reduced to 240 rpm. The reactor temperature was then increased to 85° C. for coalescence. The ph of the toner was maintained at 7.8 using 4% NaOH. After reaching 80° C., NaOH addition was stopped. After reaching 85° C., time 0 starts. The ph was slowly reduced using NaAc buffer solution. Toner was stopped at D50v 6.020 micrometers, GSDv 1.252, GSDn 1.233 and a circularity 0.958. The toner slurry was then quenched to room temperature, separated by sieving (25 micrometer), filtration, followed by washing and freeze drying.

Figure 4:
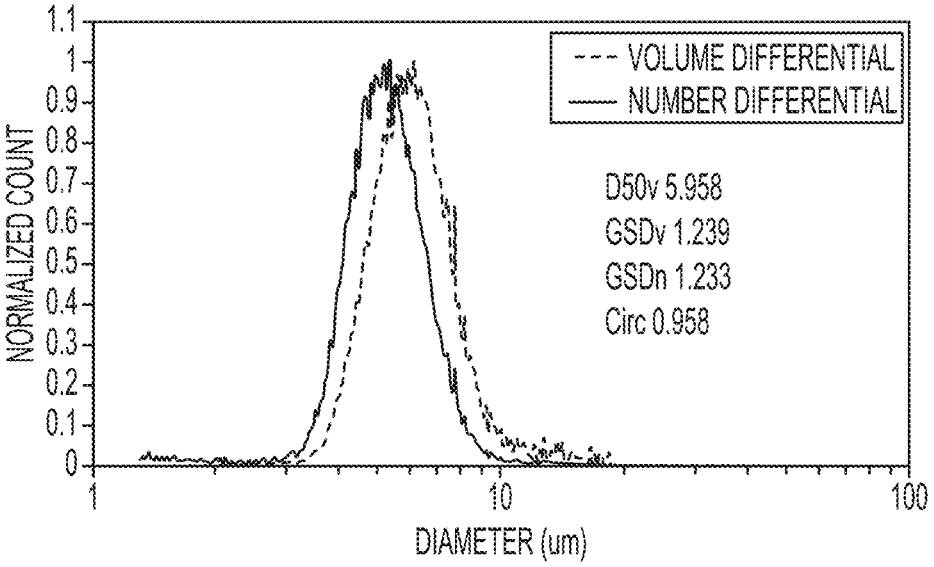
FIG. 4 is a graph showing particle size and circularity of a toner in accordance with the present disclosure.

FIG. 4 shows normalized count versus diameter (micrometers) for the particle size and circularity plot as determined using a Malvern Sysmex® Analyzer for the toner of Example 3.

A fusing test was conducted using standard fusing procedures of the toner of Example 3 and the results were acceptable.

Fusing characteristics of the toners produced were determined by crease area, minimum fixing temperature, gloss, document offset, and vinyl offset testing.

All unfused images were generated using a modified Xerox® copier. A TMA (Toner Mass per unit Area) of 1.00 $mg/cm^2$ was used for the amount of toner placed onto CXS paper (Color Xpressions® Select, 90 gsm, uncoated, P/N 3R11540) and used for gloss, crease and hot offset measurements. Gloss/crease targets were a square image placed in the centre of the page.

Samples were then fused with an oil-less fusing fixture, consisting of a Xerox® 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed, wait ten minutes to allow the temperature of the belt and pressure assembly to stabilize.

Cold offset is the temperature at which toner sticks to the fuser, but is not yet fusing to the paper. Above the cold offset temperature the toner does not offset to the fuser until it reaches the hot offset temperature.

Crease area. The toner image displays mechanical properties such as crease, as determined by creasing a section of the substrate, such as paper, with a toner image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON® coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example, of greater than unity. From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient. Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

The Minimum Fixing Temperature (MFT) measurement involves folding an image on paper fused at a specific temperature, and rolling a standard weight across the fold. The print can also be folded using a commercially available folder such as the Duplo® D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Print gloss (Gardner gloss units or "ggu") was measured using a 75° BYK Gardner gloss meter for toner images that had been fused at a fuser roll temperature range of about 120° C. to about 210° C. (sample gloss was dependent on the toner, the toner mass per unit area, the paper substrate, the fuser roll, and fuser roll temperature).

Both toner particle size, circularity, and fusing results confirmed that the present toner is successfully manufactured using a single aqueous pigmented wax dispersion rather than separate wax dispersion and pigment dispersion as previously required.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner comprising:

a resin; and a colorant wax comprising a plurality of colorant wax particles comprising a pigment core surrounded by a wax shell, wherein the colorant wax particles exhibit a particle size distribution of from about 150 to about 300 nanometers with an average particle size of about 222 nanometers; and wherein the colorant wax is prepared by (a) melting and mixing a pigment colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form the plurality of colorant wax particles;

wherein the melting and mixing of step (a) and the milling of step (b) is done in an immersion media mill; and wherein the combining of step (c) is done using a piston homogenizer.

2. The toner of claim 1, wherein the resin is polyester.

3. The toner of claim 1, wherein the resin is an amorphous polyester, a crystalline polyester, or a mixture thereof.

4. The toner of claim 1, wherein the resin is selected from the group consisting of styrenes, acrylates, methacrylates, butadienes, isoprenes, acrylic acids, methacrylic acids, acrylonitriles, and combinations thereof.

5. The toner of claim 1, wherein the resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and mixtures and combinations thereof.

6. The toner of claim 1, wherein the resin is selected from the group consisting of amorphous polyester, crystalline polyester, or a mixture thereof;

a crystalline polyester formed by reacting one or more polyol branching monomers with a diacid or diester in the presence of an optional catalyst and a further organic diol suitable for forming the crystalline resin, wherein the further organic diol is selected from the group consisting of 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, and mixtures and combinations thereof, including their structural isomers; wherein the diacid or diester is selected from the group consisting of oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, a diester or anhydride thereof, and mixtures and combinations thereof; and an amorphous polyester formed by reacting one or more polyol branching monomers with a diacid or diester in the presence of an optional catalyst and a further organic diol suitable for forming the amorphous resin, wherein the diacid or diester is selected from the group consisting of terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, lutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethladipate, dimethyl dodecylsuccinate, and mixtures and combinations thereof;

wherein the further organic diol is selected from the group consisting of 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cycloheaxanediol, diethylene glycol, bis(2-hydroxyethyl) oxide, dipropylene glycol, dibutylene, and mixtures and combinations thereof.

7. The toner of claim 1, wherein the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, polyethylene wax, ester wax, amide wax, fatty acids, fatty alcohols, fatty amides, and combinations thereof.

8. The toner of claim 1, wherein the colorant is a pigment selected from the group consisting of a magenta pigment, a cyan pigment, a yellow pigment, a black pigment, and mixtures and combinations thereof.

9. A toner comprising:

a resin; and a colorant wax comprising a plurality of colorant wax particles comprising a pigment core surrounded by a wax shell, wherein the colorant wax particles exhibit a particle size distribution of from about 150 to about 300 nanometers with a Z average particle size of about 200 nanometers; and wherein the colorant wax is prepared by (a) melting and mixing a pigment colorant with at least one wax to form a colorant concentrate, wherein the colorant concentrate contains at least 25 percent by weight of colorant; (b) milling the colorant concentrate of step (a) to form a milled colorant concentrate; (c) combining the milled colorant concentrate of (b) with water and dispersing to form the plurality of colorant wax particles;

wherein the melting and mixing of step (a) and the milling of step (b) is done in an immersion media mill; and wherein the combining of step (c) is done using a piston homogenizer.

* * * * *